US009570227B1

(12) United States Patent
Lin et al.

(10) Patent No.: US 9,570,227 B1
(45) Date of Patent: Feb. 14, 2017

(54) MAGNETIC EXCITATION COIL STRUCTURE

(71) Applicant: KINSUS INTERCONNECT TECHNOLOGY CORP., Taoyuan (TW)

(72) Inventors: Ting-Hao Lin, Taipei (TW); Chiao-Cheng Chang, Taoyuan (TW); Yi-Nong Lin, Keelung (TW)

(73) Assignee: KINSUS INTERCONNECT TECHNOLOGY CORP., Taoyuan (TW)

( * ) Notice: Subject to any disclaimer, the term of this patent is extended or adjusted under 35 U.S.C. 154(b) by 0 days.

(21) Appl. No.: 14/809,295

(22) Filed: Jul. 27, 2015

(51) Int. Cl.
*H01F 5/00* (2006.01)
*H01F 27/30* (2006.01)
*H01F 27/28* (2006.01)

(52) U.S. Cl.
CPC ..... *H01F 27/2804* (2013.01)

(58) Field of Classification Search
CPC ..... H01F 27/28; H01F 27/2804; H01F 27/32; H01F 27/323; H01F 27/324; H01F 5/06; H01F 17/06
USPC ..... 336/200, 223, 220, 205
See application file for complete search history.

(56) References Cited

U.S. PATENT DOCUMENTS 5,017,442 A * 5/1991 Watanabe ..... H01M 4/74 429/241
5,426,850 A * 6/1995 Fukutomi ..... H05K 3/428 29/847
6,160,526 A * 12/2000 Hirai ..... G06K 19/07728 235/491
2009/0079531 A1* 3/2009 Zach ..... H01F 5/003 336/200

* cited by examiner

*Primary Examiner* — Mangtin Lian
(74) *Attorney, Agent, or Firm* — Lin & Associates Intellectual Property, Inc.

(57) ABSTRACT

Disclosed is a magnetic excitation coil structure including a magnetic coil sheet formed of a thin film and rolled as a cylindrical body with a hollow hole, and an insulation layer covering the outer surface of the cylindrical body formed by the magnetic coil sheet for protection. The magnetic coil sheet includes a flexible substrate, a dielectric layer attached to the flexible substrate, and a plurality of patterned circuit layers embedded in the flexible substrate and in contact with the dielectric layer. Each patterned circuit layer is separate, and the upper surfaces of the patterned circuit layers and the upper surface of the flexible substrate form a co-plane. The magnetic coil structure provides an electrical function of coil, which is enhanced by the patterned circuit layer due to its high aspect ratio of the electrical circuit, thereby greatly increasing the whole magnetic flux and electromagnetic effect.

4 Claims, 2 Drawing Sheets

MAGNETIC EXCITATION COIL STRUCTURE

BACKGROUND OF THE INVENTION

1. Field of the Invention

The present invention generally relates to a magnetic coil structure, and more specifically to a magnetic excitation coil structure having a thin magnetic coil sheet rolled to form a multiple layered cylindrical body and covered by an insulation layer.

2. The Prior Arts

In general, an electric coil can be manufactured by simply winding a traditional enameled wire to form a ring shape, and is a common electric element used as a normal inductor or providing induced magnetic field for electromagnetic force. In particular, it needs specific magnetic excitation material to increase efficiency of conversion from magnetic flux into magnetic field. It is well known that the electrical property of the coil is improved as the winding density of the enameled wire increases. How to effectively increase the winding density is thus always one of the crucial topics for the manufacturers.

Recently, the rigid board technology has been used to manufacture the coils with the high winding density. In the rigid board technology, the electric circuit pattern is formed as the conductive wire to replace commonly used enameled wire. The aspect ratio of the electric circuit pattern is usually 2:1 or 1:1 only, and it is difficult to increase the aspect ratio up to 1:2 or more. As a result, magnetic flux and electromagnetic effect can not be further improved due to limited winding density, and overall performance and the application field are adversely affected.

Therefore, it is greatly needed to provide a new magnetic excitation coil structure directly employing current manufacturing equipments to increase the aspect ratio up to 1:2 or more, improve electrical performance of coil and enhance magnetic flux and electromagnetic effect, thereby overcoming the above problems in the prior arts.

SUMMARY OF THE INVENTION

The primary objective of the present invention is to provide a magnetic excitation coil structure, which is formed a cylindrical coil assembly with multiple layers, and has a hollow cylindrical space at the center such that the magnetic excitation coil structure possesses an electrical function of coil and can be used as an inductor to implement a magnetic excitation coil.

The magnetic excitation coil structure of the present invention generally comprises a magnetic coil sheet and an insulation layer. The magnetic coil sheet is formed of a thin film and rolled as a cylindrical body with a hollow hole, and the insulation layer covers the outer surface of the cylindrical body formed by the magnetic coil sheet for protection.

The magnetic coil sheet comprises a flexible substrate, a dielectric layer and a plurality of patterned circuit layers. The dielectric layer is attached to the flexible substrate, and the patterned circuit layers are embedded in the flexible substrate and in contact with the dielectric layer. Thus, the upper surfaces of the patterned circuit layers and the upper surface of the flexible substrate substantially form a coplane.

In addition, the patterned circuit layers are formed of an electrically conductive material and horizontally configured in the flexible substrate. In particular, any two of the patterned circuit layers are electrically separated and not in contact.

The flexible substrate is formed of a flexible electrical insulation material, the dielectric layer is formed of a dielectric material, and the insulation layer is formed of an electrical insulation material. More specifically, the patterned circuit layers are formed of an electrically conductive material like a thin copper foil, which is formed by chemical etching of mechanical pressing and cutting such that an aspect ratio of the patterned circuit layer is up to within 2:1 and 1:2.

The flexible substrate is rolled according to the actual application, and may have a closed shape such as a rectangle, square, circle or oval.

Furthermore, the magnetic excitation coil structure of the present invention may further comprise a positive end and a negative end, which are connected to two ends of the patterned circuit layer, respectively, for connection with external electrical units like electrical devices or electronic elements. Since the patterned circuit layer conducts electrical current via the positive and negative ends and serves as the copper cord in the traditional enameled wire, and the flexible substrate serves as the insulation layer of the enameled wire, the magnetic coil structure of the present invention can substantially replace the whole enameled wire to implement the desired electrical performance.

In addition, the patterned circuit layer is formed of the circuit with a smaller width. In other words, the respective conductive line structure of the patterned circuit layer has a smaller width like a copper foil with a smaller width. The ratio of the thickness of the flexible substrate to the surface area of the smaller circuit, which is usually called aspect ratio, is far smaller than that of the traditional enameled wire using a winding coil. As a result, the effective winding coil number and the density of the winding coil per area are greatly increased, thereby increasing the magnetic flux based on Gauss law.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
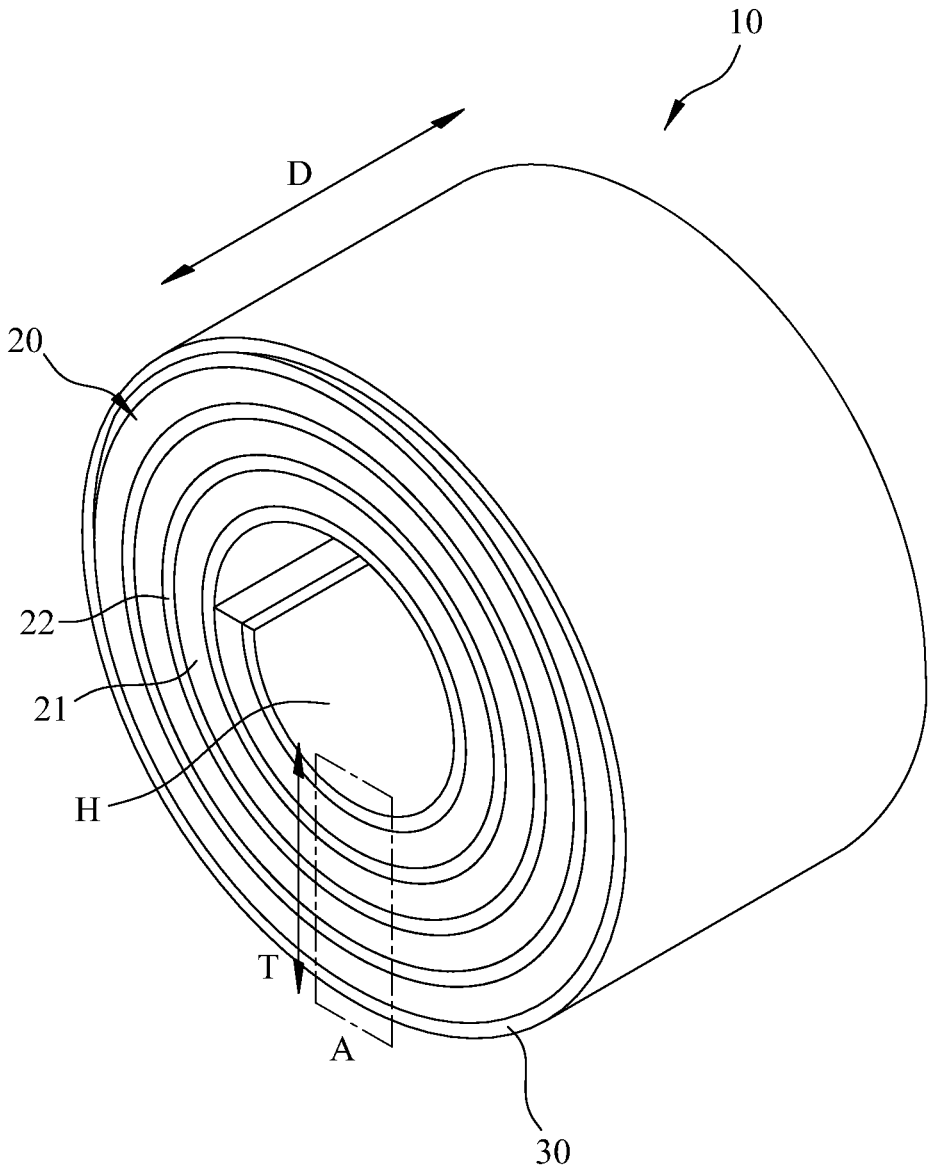
FIG. 1 is a perspective view showing the magnetic excitation coil structure according to the embodiment of the present invention.
Figure 2:
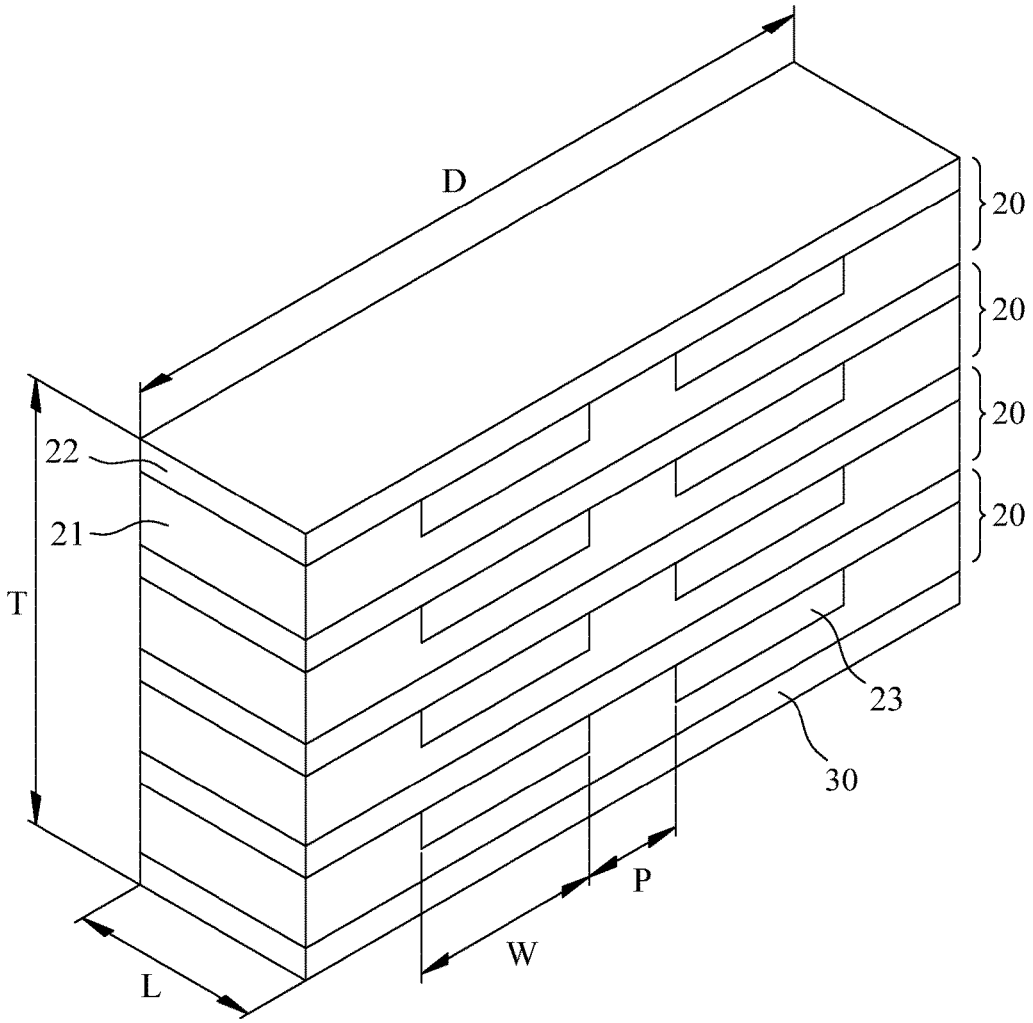
FIG. 2 is an enlarged view showing the region A in FIG. 1.

Please refer to FIGS. 1 and 2. FIG. 1 is a perspective view showing the magnetic excitation coil structure according to the embodiment of the present invention, and FIG. 2 is an enlarged view showing the region A in FIG. 1. As shown in FIGS. 1 and 2, the magnetic excitation coil structure 10 of the present invention generally comprises a magnetic coil sheet 20 and an insulation layer 30. The magnetic coil sheet 20 is formed of a thin film and rolled as a cylindrical body with a hollow hole H, and the insulation layer 30 covers the outer surface of the cylindrical body formed by the magnetic coil sheet 20 for protection. Thus, the rolled magnetic excitation coil structure 10 possesses an electrical function of coil like an inductor, and can serve as a magnetic excitation coil.

Specifically, the magnetic coil sheet 20 comprises a flexible substrate 21, a dielectric layer 22 and a plurality of patterned circuit layers 23. The dielectric layer 22 is attached to the flexible substrate 21, and the patterned circuit layers 23 are embedded in the flexible substrate 21 and in contact with the dielectric layer 22 such that the upper surfaces of the patterned circuit layers 23 and the upper surface of the flexible substrate 21 substantially form a co-plane. As shown in FIG. 2, the dielectric layer 22 has a bottom surface flush and in contact with the co-plane. Also, the patterned circuit layers 23 are horizontally configured in the flexible substrate 21, any two of the patterned circuit layers 23 are electrically separated.

The above flexible substrate 21 is formed of a flexible electrical insulation material, the dielectric layer 22 is formed of a dielectric material, and the insulation layer 23 is formed of an electrical insulation material. For instance, the patterned circuit layers 23 are formed of an electrically conductive material like a very thin copper foil, which is formed by chemical etching of mechanical pressing and cutting. As a result, the aspect ratio of the patterned circuit layer 23 can reach up to within 2:1 and 1:2.

Furthermore, the flexible substrate 21 can be rolled to form a closed shape such as a rectangle, square, circle or oval based on the actual application. However, it should be noted that the oval shape is shown for the closed shape as an illustrative example only for clearly describing the features of the present invention. It is thus not intended to limit the scope of the present invention.

Moreover, two electric patterned layers 23 in parallel shown in FIG. 2 is only used to clearly describe the features of the present invention, and not intended to limit the scope of the present invention. In other words, the number of electric patterned layers 23 can be any positive integer.

In addition, the magnetic excitation coil structure 10 of the present invention may further comprise a positive end and a negative end (not shown), which are connected to two ends of the patterned circuit layer 23, respectively, for connection with external electrical units like electrical devices or electronic elements.

More specifically, FIG. 1 shows the magnetic excitation coil structure 10 has a thickness T and a depth D, and FIG. 2 locally enlarges the region A in FIG. 1 to illustrate the stack structure of the wound magnetic coil sheet 20. In particular, a pitch P is formed between two adjacent patterned circuit layers 23.

Overall speaking, the patterned circuit layer 23 of the present invention functions as the copper cord in the traditional enameled wire to conduct electrical current, and the flexible substrate 21 exhibits the electrical function performed by the insulation layer of the enameled wire such that the magnetic coil structure 10 of the present invention substantially replaces the enameled wire.

Additionally, the magnetic coil structure 10 of the present invention exhibits two advantages.

First, the patterned circuit layer 23 is formed of the smaller electrical circuit. In other words, the patterned circuit layer 23 has a smaller width W like the copper foil with a small width. The ratio of the thickness of the flexible substrate 21 to the surface area of the smaller circuit, which is usually called aspect ratio, is far smaller than that of the traditional enameled wire using a winding coil. As a result, the effective winding coil number and the density of the winding coil per area are greatly increased, thereby increasing the magnetic flux based on Gauss law.

Second, the flexible substrate 21 can be configured to any closed shape according to actual application such as square, circle, thereby improving workability.

Furthermore, compared with the traditional rigid board having the aspect ratio of the rigid board is generally 2:1 or 1:1, the aspect ratio of the patterned circuit layer 23 of the present invention, which is specifically defined as the ratio of the thickness to the length of the patterned circuit layer 23, can easily reach up to within 2:1 and 1:2, or more than 1:2, by simply using current manufacturing equipments. Thus, the thickness of the patterned circuit layer 23 is easily reduced and the conductive connections are tightly packed in the winding direction so as to effectively enhance electrical performance of the coil and increase magnetic flux and electromagnetic effect.

In particular, since the present invention does not need any new developed machine, the manufacturing cost is advantageously lower, thereby greatly increasing industrial utility.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A magnetic excitation coil structure, comprising:

a magnetic coil sheet formed of a thin film, rolled as a cylindrical body with a hollow hole, and comprising a flexible substrate, a dielectric layer attached to the flexible substrate, and a plurality of patterned circuit layers embedded in the flexible substrate and in contact with the dielectric layer such that upper surfaces of the patterned circuit layers and an upper surface of the flexible substrate form a co-plane flush and in contact with a bottom surface of the dielectric layer; and an insulation layer covering an outer surface of the cylindrical body formed by the magnetic coil sheet for protection, wherein the patterned circuit layers are formed of an electrically conductive material and horizontally configured in the flexible substrate, any two of the patterned circuit layers are electrically separated, the flexible substrate is formed of a flexible electrical insulation material, the dielectric layer is formed of a dielectric material, and the insulation layer is formed of an electrical insulation material.

2. The magnetic excitation coil structure as claimed in claim 1, wherein the flexible substrate is rolled to have a closed rectangular, square, circular or oval shape.

3. The magnetic excitation coil structure as claimed in claim 1, wherein the electrically conductive material is a copper foil, and an aspect ratio of the patterned circuit layer is within 2:1 and 1:2.

4. The magnetic excitation coil structure as claimed in claim 1, further comprising a positive end and a negative end, wherein the positive end and the negative end are connected to two ends of the patterned circuit layer, respectively, for external electrical connection.

* * * * *